US005806476A

United States Patent [19]

Håkansson

[11] Patent Number: 5,806,476

[45] Date of Patent: Sep. 15, 1998

[54] VALVE MECHANISM IN AN INTERNAL COMBUSTION ENGINE

[75] Inventor: Nils Olof Håkansson, Stenkullen, Sweden

[73] Assignee: AB Volvo, Gothenburg, Sweden

[21] Appl. No.: 930,261

[22] PCT Filed: Mar. 29, 1996

[86] PCT No.: PCT/SE96/00416

§ 371 Date: Sep. 29, 1997

§ 102(e) Date: Sep. 29, 1997

[87] PCT Pub. No.: WO96/30630

PCT Pub. Date: Oct. 3, 1996

[30] Foreign Application Priority Data

Mar. 30, 1995 [SE] Sweden ..... 9501160

[51] Int. Cl.[6] ..... F01L 13/00; F01L 13/06; F02D 13/04

[52] U.S. Cl. ..... 123/90.17; 123/90.6; 123/568

[58] Field of Search ..... 123/90.15, 90.16, 123/90.17, 90.31, 90.6, 568; 74/567, 568 R; 251/251

[56] References Cited

U.S. PATENT DOCUMENTS

| | | | |
|---|---|---|---|
| 4,357,917 | 11/1982 | Aoyama | 123/568 |
| 4,886,022 | 12/1989 | Nakai | 123/90.17 |
| 5,103,779 | 4/1992 | Hare, Sr. | 123/90.6 |
| 5,303,686 | 4/1994 | Kanesaka | 123/568 |
| 5,402,759 | 4/1995 | Ding et al. | 123/90.6 |
| 5,404,770 | 4/1995 | Kruger | 123/90.17 |
| 5,505,168 | 4/1996 | Nagai et al. | 123/90.17 |
| 5,603,292 | 2/1997 | Hakansson | 123/568 |

FOREIGN PATENT DOCUMENTS

| | | |
|---|---|---|
| 0 594 104 | 4/1994 | European Pat. Off. . |
| 37 05 128 | 9/1988 | Germany . |
| WO 94/15075 | 7/1994 | WIPO . |

*Primary Examiner*—Weilun Lo
*Attorney, Agent, or Firm*—Young & Thompson

[57] ABSTRACT

Valve mechanism in an internal combustion engine with a control device arranged to selectively open the engine exhaust valves during the intake stroke to permit intake of exhaust. The control device comprises a slide (13) displaceably mounted in a radial channel (12) in each of the cam shaft cam elements (2) for the exhaust valves. The slide (13) has a second lifting ridge (16) angularly displaced relative to the ordinary lifting ridge (22). The control device also comprises a wedge element (6) cooperating with the slide in a bore in the cam shaft. The wedge element when displaced axially produces a radial displacement of the slide.

10 Claims, 2 Drawing Sheets

VALVE MECHANISM IN AN INTERNAL COMBUSTION ENGINE

FIELD OF THE INVENTION

The present invention relates to a valve mechanism in an internal combustion engine, comprising at least one intake valve and at least one exhaust valve in each cylinder, at least two rocker arms mounted on a rocker arm shaft for each cylinder for operating the valves, at least one cam shaft with a cam element for each rocker arm, said cam element having a first lifting ridge for actuating an associated rocker arm, and a control mechanism, by means of which the exhaust valve can be opened during the intake stroke of the engine to provide intake of exhaust into the cylinder during the intake stroke.

BACKGROUND OF THE INVENTION

SE-A-501 437 reveals a valve mechanism of the above mentioned type which permits recirculation of exhaust from the exhaust side to the cylinder during the intake stroke without requiring the gate and valve devices of the conventional recirculation system on the exhaust and intake sides. Such a valve mechanism is particularly advantageous for use in turbo-charged engines, where the pressure under certain operating conditions is higher on the intake side than on the exhaust side and where it would otherwise be necessary to use some form of pumping device to get the exhaust to the pressure side of the turbo compressor.

The known valve mechanism comprises a shaft which is rotatable and axially displaceably mounted parallel to the rocker arm shaft and which has pivot arms which are disposed to transmit a portion of the movement of the intake rocker arm to a rocker movement of the exhaust rocker arm.

SUMMARY OF THE INVENTION

The purpose of the present invention is to achieve a valve mechanism of the type described by way of introduction, which has a control mechanism which can be integrated into the cam shaft itself, so that the engine design as regards its valve system can be maintained without any modifications whatsoaver.

This is achieved according to the invention by virtue of the fact that the control mechanism comprises a slide displaceably mounted in a radial channel in the cam element for the exhaust valve and which is angularly displaced relative to the first lifting ridge, said slide having a second lifting ridge and means integrated into the cam shaft to achieve a radial displacement of the slide between a first position, in which the highest point of the second lifting ridge lies at most level with the base circle ("a") of the cam element, and a second position, in which the highest point of the second lifting ridge lies above the base circle.

The invention is based on the fact that the pressure in the cylinder during the intake stroke is low and that the second lifting ridge of the cam element only needs to overcome the force of the exhaust valve spring, which means that the surface pressure on the second lifting ridge and on the exhaust valve tappet will not be higher than what can be permitted even when the second lifting ridge is substantially shorter axially than the tappet cam follower.

BRIEF DESCRIPTION OF THE DRAWING

The invention will be described in more detail below with reference to examples shown in the accompanying drawings, where.

DETAILED DESCRIPTION OF THE INVENTION

Figure 1:
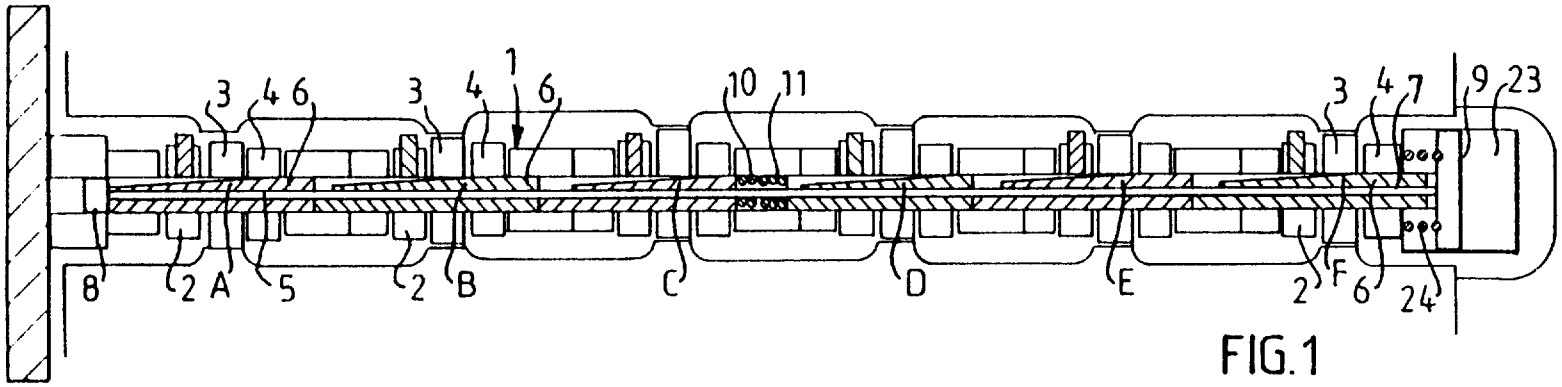
FIG. 1 shows a partially cut away side view of a cam shaft with a control mechanism according to the invention.
Figure 4:
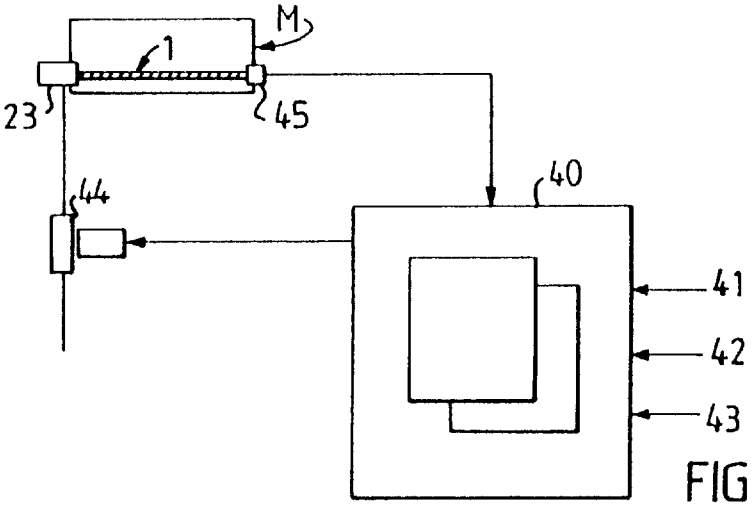
FIG. 4 is a schematic diagram of a control system for the mechanism according to the invention.

The cam shaft generally designated 1 in FIG. 1 is intended for a six cylinder diesel engine and has for each cylinder a cam element 2 for the cylinder exhaust tappet, a cam shaft bearing 3 and a cam element 4 for its intake tappet. In the Figure, all of the cam elements 2 for the exhaust valves are shown with the same angular setting for the sake of illustration. In practice of course, they will be angularly displaced corresponding to the ignitions sequence of the engine. The cam shaft 1 is made with a central through-bore 5, in which six wedge elements 6, one for each cam element 2, are axially displaceably mounted. The wedge elements 6 each have a through-bore **6*a* and are threaded onto a drawbar 7, which has at one end a stop 8 and at the other end a hydraulic piston 9. The wedge elements 6 are grouped into two groups of three and with a space 10 between the groups, in which a helical spring 11** is laid.

Figure 3:
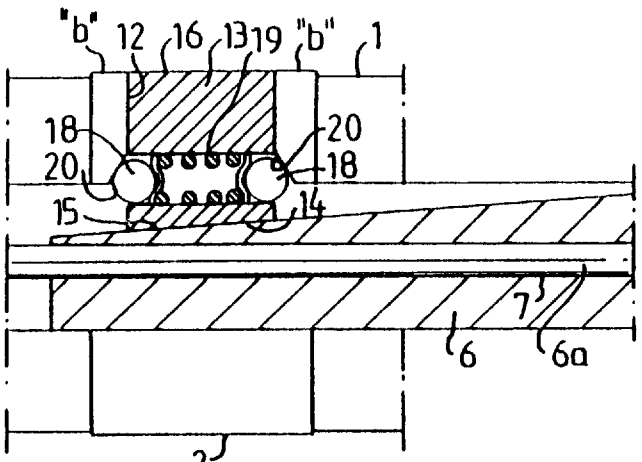
FIG. 3 is an enlarged axial section through a portion of the cam shaft in FIG. 1.
Figure 2:
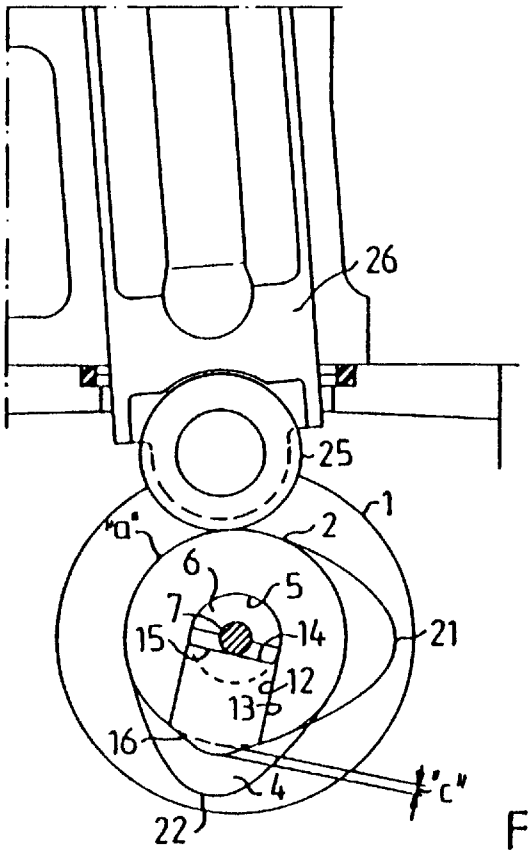
FIG. 2 is a radial section through the cam shaft in FIG. 1 and a portion of an exhaust tappet.

As can be seen in more detail in FIG. 2 and 3, the cam elements 2 for the exhaust valves each have a radial channel 12 which opens into the axial bore 5. In this radial channel 12 there is a radially displaceable slide 13, which has a flat inner end surface 14 which has the same inclination as a facing flat surface 15 on the wedge element 6. This flat surface 15 is made by bevelling the circular profile of the wedge element adapted to the bore 5. The channel 12 and the slide 13 have square or rectangular cross section. The slide 13 has an arcuate distal end portion 16 which forms a second lifting ridge on the exhaust valve cam element 2, and the highest point of which, in the position shown in FIG. 3, lies level with the base circle "a" of the cam element 2. The slide 13 is biased towards this position by a pair of balls 18 in a bore 17 in the slide. The balls 18 are pressed by a spring 19 between them against inclined wall surfaces 20 at the inner end of the channel 12. The slide 13 and thus the second lifting ridge 16 are angularly displaced relative to the usual lifting ridge 21 of the cam element 2 and, as can be seen from FIG. 2, are in phase with the lifting ridge 22 of the intake valve cam 4.

The piston 9 joined to the drawbar 7 is biased to the right (FIG. 1) in its cylinder 23 by a spring 24, which, when it overcomes an oppositely directed pressure medium force on the piston 9, keeps the drawbar 7 and the wedge element 6 with it in its position shown in FIG. 3, in which, as was mentioned above, the lifting ridge 16 of the slide has its highest point level with the base circle "a" of the cam element 2.

The cam element 2 and its cam follower in the form of a roller 25 on an exhaust tappet 26 has a larger axial extent than the channel 12 and the slide 13. In its retracted position (FIG. 3) of the slide 13, the cam follower 25 can thus roll on the outer portions "b" of the cam element 2 on either side of the channel 12 without being affected by the lifting ridge 16. In this position there is no recirculation of exhaust.

When the pressure in the cylinder chamber 23 creates a force on the piston 9, exceeding the force from the spring 24, the drawbar 7 is displaced to the left (as seen in FIGS. 1 and 3) and brings with it the wedge 16 a distance depending on the pressure, which results in the second lifting ridge 16 being pushed out so that its highest point will be outside the base circle "a" of the cam element 2. In FIG. 2, the lift is labelled "c" and, as can be seen in FIG. 2, the resulting opening of the exhaust valve during the intake stroke will reach its maximum at the same time as the intake valve reaches its maximum opening. The degree of opening of the exhaust valve when there is exhaust recycling, depends on the position of the wedge 6 relative to the slide 13, and can be continuously varied depending on the various control parameters between zero and a predetermined maximum. When the pressure in the cylinder 23 drops and the wedge 16 is returned via the drawbar 7 and the spring 24 to its starting position, the slide 13 is retracted under the influence of the balls 18 to its inactive position. The wedge angle between the slide 13 and the wedge 6 is selected so as to be self-braking.

The Functional description above relates to the process with respect to a single cylinder. In practice, in the six-cylinder embodiment shown in FIG. 1, all of the wedges cannot be moved at the same time, since one or several of the slides 13 will always be loaded by the associated cam follower roller 25 at the moment of displacement. For this reason the wedges 6 are grouped in two groups with an intermediate take-up spring 10. When the pressure in the cylinder 23 is increased in order to open the exhaust valves during the intake stroke, the wedges 6 and the group D,E,F are displaced as soon as they are unloaded, thus compressing the take-up spring 10. When the wedges 6 in the group A,B,C have been unloaded, they are displaced by the take-up spring 10, so that the slide 13 in this group as well will be moved out to their active positions. When the slides 13 are to be retracted to eliminate exhaust return during the intake stroke, the pressure in the cylinder 23 is lowered and the wedges 6 in the group A,B,C are returned while compressing the take-up spring 10. When the wedges 6 in the group D,E,F are unloaded, they are moved by the take-up spring to the starting position.

The pressure in the cylinder 23 thus determines the axial position of the wedges 6 in the cam shaft bore and thus also the lift of the exhaust valves when there is exhaust return. This pressure is regulated by the central control unit 40 of the engine 14, to which there are fed values of rpm, load, temperature etc, as is indicated by the arrows 41, 42 and 43. The control unit 40 controls a control valve 44 and is programmed with various exhaust recycling values as a function of engine rpm and load or engine temperature. The command value for the piston 9 and the drawbar 7 is compared with the actual value from an inductive sensor 45 connected to the drawbar 7 and the control unit 4 provides a signal depending on the values obtained to the control valve 44 to regulate the pressure in the cylinder 23 so that the drawbar is set at a position which provides the desired exhaust return.

I claim:

1. Valve mechanism in an internal combustion engine, comprising at least one intake valve and at least one exhaust valve in each cylinder, at least two rocker arms mounted on a rocker arm shaft for each cylinder for operating the valves, at least one cam shaft with a cam element for each rocker arm, the cam element for the exhaust valve having a first lifting ridge for actuating an associated rocker arm, and a control mechanism for opening the exhaust valve during the intake stroke of the engine to provide intake of exhaust into the cylinder during the intake stroke, wherein the control mechanism comprises a slide (13) displaceably mounted in a radial channel (12) in the cam element (2) for the exhaust valve and which is angularly displaced relative to the first lifting ridge (21), said slide having a second lifting ridge (16) and means (6) integrated into the cam shaft (1) for achieving a radial displacement of the slide between a first position, in which the highest point of the second lifting ridge lies at most level with a base circle ("a") of the cam element, and a second position, in which the highest point of the second lifting ridge lies above the base circle.

2. Valve mechanism according to claim 1, wherein the radial channel (12) opens into an axial bore (5) in the cam shaft (1) and that the means integrated into the cam shaft comprise a wedge element (6) axially displaceable in the bore and having an inclined surface (15) against which there abuts a radial inner surface (14) of the slide (13) so that axial displacement of the wedge element results in radial displacement of the slide.

3. Valve mechanism according to claim 1, wherein the radial channel (12) has an axial extent which is less than the axial extent of the cam element (2).

4. Valve mechanism according to claim 2, wherein the radially interior surface (14) of the slide (13) is complementary to the inclined surface (15) of the wedge element and that the angle of inclination is selected so that the interaction between the slide and the wedge element is self-braking.

5. Valve mechanism according to claim 1, wherein the slide (13) and the cam shaft (1) have cooperating means (18,19,20), which limit the outwardly directed radial displacement of the slide and spring-bias the slide radially inwards.

6. Valve mechanism according to claim 5, wherein the cooperating means comprise at least one wall portion (20) in the slide channel (12) which is so inclined that a ball (18) resting in a cavity in the slide and spring-biased against the wall portion, produces a radially inwardly directed force on the slide.

7. Valve mechanism according to claim 6, wherein the slide channel (12) has two diametrically oppositely inclined wall portions (20) and the slide has an axial through-passage, which houses two balls (28) and a spring device (19) therebetween.

8. Valve mechanism according to claim 2, wherein the wedge element (6) is joined to a pressure medium actuated piston cylinder device (9,23).

9. Valve mechanism according to claim 8, wherein the wedge element (6) is spring-biased towards a position in which the second lifting ridge (16) lies within the base circle ("a") of the cam element, and is pressure medium-loaded in the opposite direction, and that a control unit (40) is arranged which regulates the medium pressure as a function of values fed into the control unit relating to at least engine speed, load and the position of the wedge element (6) sensed by a position sensor (45).

10. Valve mechanism according to claim 8 for a multi-cylinder engine with a plurality of cylinders in a row, wherein each wedge (6) is made with an axial through-channel **(6*a*), that a common drawbar (7)**, which is spring- and pressure medium-loaded, extends through the channels of sequentially arranged wedge elements and that the wedge elements are divided into at least two separate groups (A,B,C;D,E,F) separated by a take-up spring.

* * * * *